US006513511B1

(12) United States Patent
Garthe et al.

(10) Patent No.: US 6,513,511 B1
(45) Date of Patent: Feb. 4, 2003

(54) BOW PRE-LOADING METHODS AND APPARATUS

(76) Inventors: Ronald D. Garthe, 1240 Castlewood, DeWitt, MI (US) 48820; John M. Hanley, 1654 W. Pratt Rd., DeWitt, MI (US) 48820

( * ) Notice: Subject to any disclaimer, the term of this patent is extended or adjusted under 35 U.S.C. 154(b) by 0 days.

(21) Appl. No.: 09/775,992

(22) Filed: Feb. 5, 2001

(51) Int. Cl.[7] ..... F41B 5/00
(52) U.S. Cl. ..... 124/25.6; 124/23.1; 124/86
(58) Field of Search ..... 124/23.1, 25.6, 124/86, 88, 35.2

(56) References Cited

U.S. PATENT DOCUMENTS 4,615,326 A 10/1986 Rathbun ..... 124/88
4,919,107 A * 4/1990 Bunts
5,146,908 A 9/1992 Larson ..... 124/88
5,205,268 A 4/1993 Savage ..... 124/24.1
5,373,831 A 12/1994 Cushman ..... 124/25.6
5,465,705 A * 11/1995 Baeseman ..... 124/88
5,524,602 A 6/1996 Papandrea ..... 124/89
5,553,597 A 9/1996 Sparks ..... 124/44.5
6,012,440 A * 1/2000 Grindle ..... 124/86
6,161,532 A * 12/2000 Goff et al. ..... 124/86 X

FOREIGN PATENT DOCUMENTS

DE 19627276 1/1998

* cited by examiner

*Primary Examiner*—John A. Ricci
(74) *Attorney, Agent, or Firm*—Charles M. Kaplan

(57) ABSTRACT

An archery bow may be pre-loaded by methods and mechanisms that employ a piston in a hollow cylindrical tube to compress a gas or spring inside the tube so as to store the energy needed to move a bow string to a pre-loaded position when the stored energy is released.

20 Claims, 6 Drawing Sheets

BOW PRE-LOADING METHODS AND APPARATUS

BACKGROUND OF THE INVENTION

This invention relates to archery bows and more particularly to improved methods and attachments for pre-loading the bows. Modern compound bows require such a strong pull that many people can not use them. Various mechanisms for pre-loading archery bows have been proposed in the past. However such prior art mechanisms were unduly complicated, expensive and difficult to use. Also, prior pre-loading arrangements were exposed and easily contaminated by dirt and debris encountered by archers and hunters out of doors, and could be dangerous if misfiring of an arrow occurred during pre-loading.

OBJECTIVES OF THE INVENTION

Accordingly, it is an object of this invention to provide improved methods and attachments for pre-loading archery bows.

Another object is to provide a pre-loading attachments and methods for compound bows that enable people of low to moderate strength to use such bows because the bow string can be easily drawn and held at the let-off pull.

An additional object is to provide bow pre-loading devices that will not cock bows to the degree that a bow can be considered a cross bow.

Another object is to provide bow pre-loading devices that do not unbalance the bows to which they are attached.

A further object is to provide pre-loading attachments for bows that can be easily adjusted in the field.

Another object is to provide pre-loading mechanisms for bows that have major working components that can not be contaminated because they are sealed inside of a tube.

An additional object is to provide bow attachments that do not interfere with the archer's aim.

Another object is to provide archery pre-loading arrangements that are safer because they move slowly when they release stored energy.

A further object is to provide adjustable pre-loading attachments for archery bows that are rugged, economical, balanced, attractive, safe and easy to use and maintain, and which do not possess defects found in similar prior art pre-loaders.

A further object is to provide improved methods for easily adjusting the amount of pull that an archer is required to exert on a bow string.

Other objects and advantages of the archery bow attachments and methods incorporating this invention will be found in the specification and claims and the scope of the invention will be set forth in the claims.

DESCRIPTION OF THE INVENTION

Figure 1:
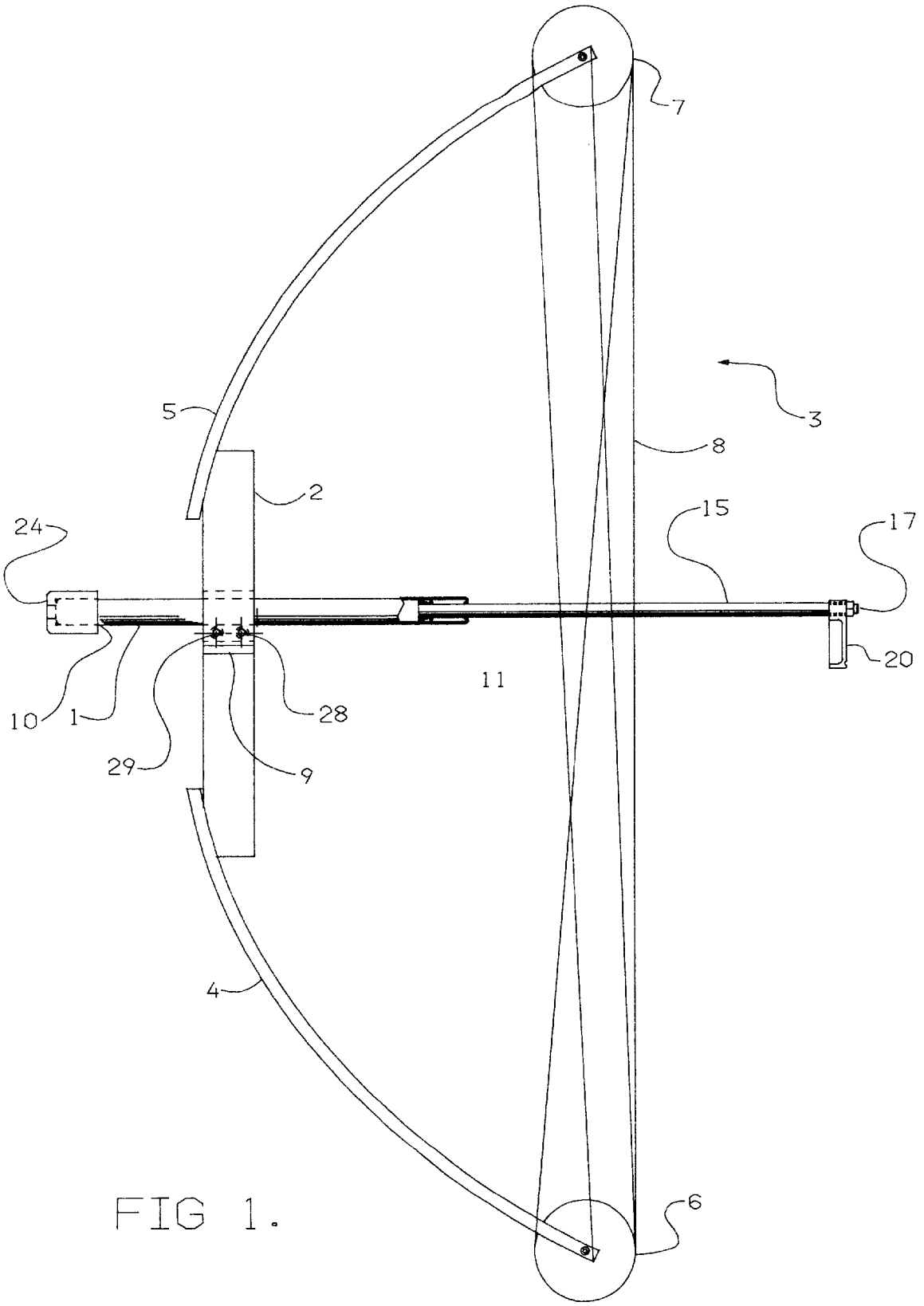
FIG. 1 is a schematic side view of an embodiment of a bow in accord with this invention.

The drawing shows an pre-loading archery bow attachments in accord with our invention. In the embodiment of FIGS. 1–6, a hollow cylindrical tube 1 is attached to the hand grip 2 of a conventional compound bow 3 that includes bow arms 4 and 5, pulleys 6 and 7 attached to the arms, and a bow string 8 encircling the pulleys. Grip 2 may have an arrow rest 9 on one side thereof. The tube 1 has one closed end 10 and an opposite open end 11. A piston 12 is sealed inside of tube 1 by gaskets 13. The piston 12 slides back an forth in the tube 1. The piston can slide in a first direction toward the closed end 10, which is also the direction in which the bow 3 propels arrows 14. The piston can also slide in a second direction toward end 11 that is opposite to the first direction.

Figure 2:
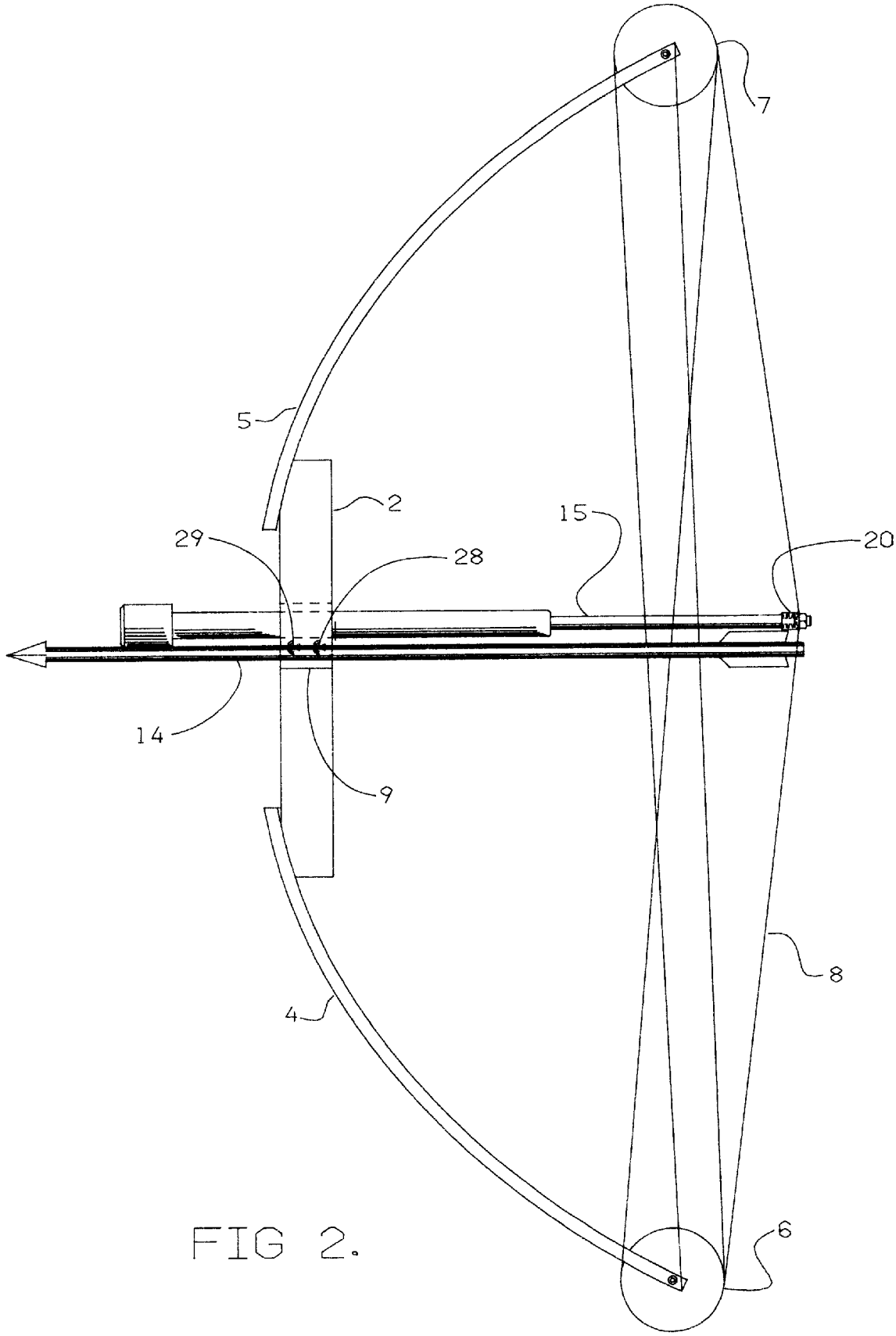
FIG. 2 is a schematic side view of the FIG. 1 embodiment in pre-loaded position.
Figure 3:
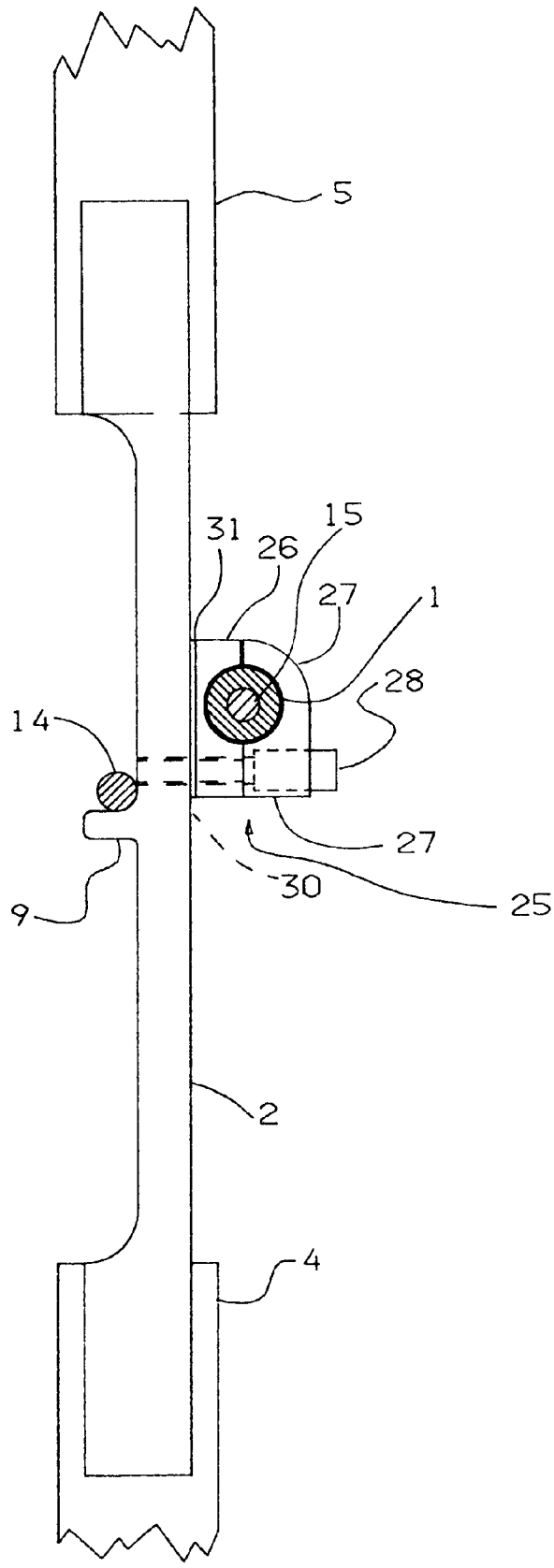
FIG. 3 is an enlarged partial rear view.
Figure 4:
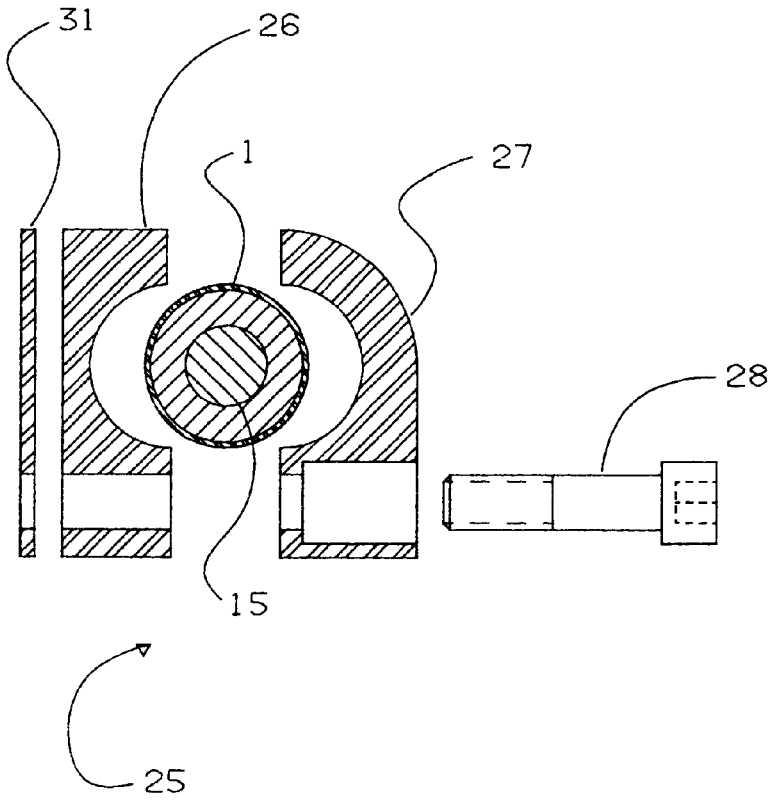
FIG. 4 is an enlarged exploded cross sectional end view of the clamp.
Figure 6:
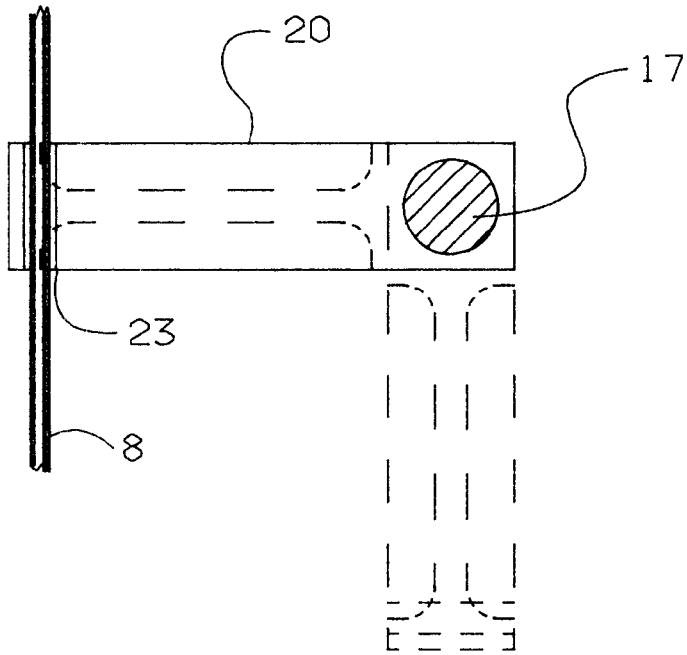
FIG. 6 is an enlarged end view of the bow string capture arm.

A rod 15 has one of its ends 16 attached to the piston 12. The rod passes through a sealed circular hole in the end 11 and has a threaded opposite end 17 that projects beyond the tube 1. A bow string capture arm 20 is attached to the end 17 of the rod by a threaded nut 21. The end 17 is of reduced diameter and passes through a circular hole 22 in the arm. The arm 20 can rotate from an essentially horizontal bow string engaging position, as shown in FIGS. 2 and 6, to an essentially vertical release position, as shown in FIGS. 1 and 6. The bow string is captured in a groove 23. When the bow string 8 is drawn past the end of rod 15, gravity causes the arm 20 to pivot to its vertical position out of the way of the bow string. A counter weight 24 may be provided on the end 10 of tube 1 to balance the weight of the tube, rod and arm that extend past the opposite side of the hand grip.

The tube 1 may be held on the hand grip 2 by a clamp 25. The jaws 26 and 27 of the clamp are held in place by bolts 28 and 29. The bolts pass through holes in the jaws 26 and 27 and thread into tapped holes 30 in the hand grip. Jaw 26 is held adjacent the hand grip, and shims such as 31 may be provided to properly position the clamp on bows made by different manufacturers. Loosening of the bolts 28 and 29 enables the tube 1 to be moved back and forth with respect to the bow string 8 in the first and opposite directions. This permits adjustment of the location of the bow string capture arm 20 with respect to the bow string when the rod 15 is fully extended, and this adjusts the degree to which the bow string can be pre-loaded. The clamp 25 is attached to the grip 2 on the side opposite to the arrow rest 9.

The hollow tube 1 must contain means for storing the energy required to move and pre-load the bow string 8 to a predetermined position. For example the bow string 8 could be pre-loaded to the let-off point where the draw pull drops significantly (e.g. from 60 to 30 pounds). In the embodiment of FIGS. 1–6, the hollow tube 1 contains a fluid 32 such as an inert gas like nitrogen that can be compressed by the piston 12 and a small amount of lubricating oil. Preferably, the piston 12 and tube 1 function as a conventional gas spring which has a piston assembly that is precharged on one side. The output force results from the differential between the pressure in the cylinder and atmospheric pressure outside of the cylinder. As the piston rod moves into the cylinder during the compression stroke, the internal pressure increases according to the volume of gas displaced. The structure of the piston assembly of any specific gas spring may be complex, as for example by having perforations permitting movement of fluid across the piston and numerous seals and valves. The piston 12 has been depicted schematically herein because its specific gas spring structure is not part of the present invention. The gas springs used to practice our invention can be purchased as off the shelf components from automotive supply retailers. Model C16-18868 25 pounds Suspa 004 gas spring manufactured by Suspa Incorporated has been used successfully.

Movement of the piston 12 in the first direction toward the closed end 10 of the hollow tube 1 compresses the fluid 32 and loads the gas spring. After the fluid has been compressed, engaging the bow string 8 on the arm 20 enables release of the energy stored in the compressed fluid to move the piston and bow string to a predetermined position where the bow string is pre-loaded the desired amount. The pre-loading position may be predetermined so that insufficient energy is stored in the pre-loaded bow string 8 to fire an arrow, and therefore a bow with our mechanism attached would not be considered a cross bow.

Figure 7:
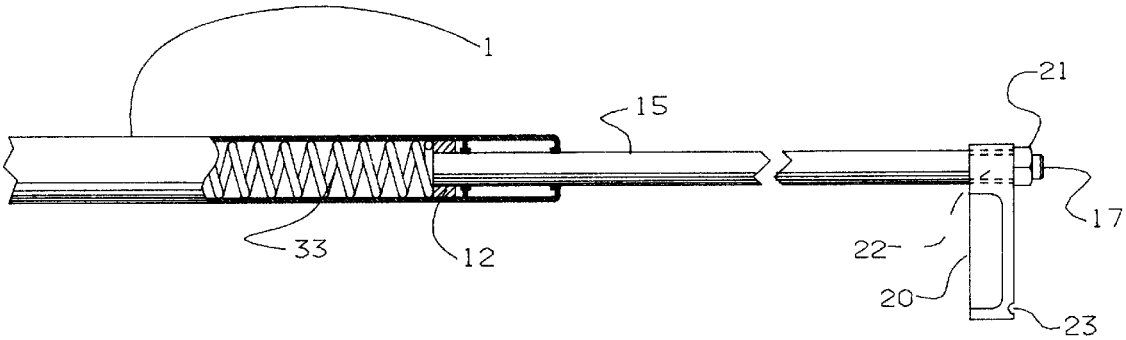
FIG. 7 is an enlarged partially cross sectional side view of another embodiment of the invention.
Figure 5:
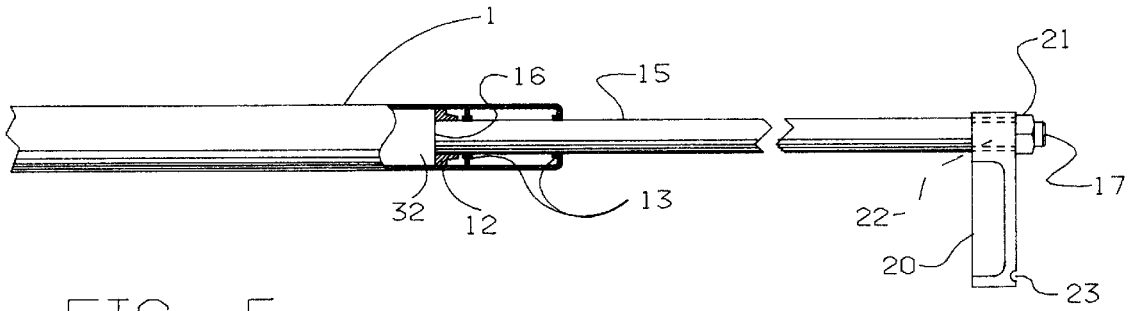
FIG. 5 is an enlarged partially cross sectional side view of the piston and tube.

FIG. 7 shows another embodiment that is identical to the embodiment of FIGS. 1–6 except that the energy storing means in the hollow tube 1 is a metal or plastic coil compression spring 33. Movement of the piston 12 in the first direction toward the closed end of the hollow tube 1 compresses the spring 33. After the spring 33 has been compressed, engaging the bow string 8 on the arm 20 enables release of the energy in the compressed spring to move the piston and bow spring to a predetermined position where the bowstring is pre-loaded the desired amount.

It is thus apparent that by the practice of our invention, an archery bow 3 can be a pre-loaded by the steps of attaching a hollow tube 1 to the bow and moving a piston 12 inside of the hollow tube in a way that stores energy inside of the hollow tube by compressing a fluid 32 or a spring 33 in the hollow tube. The piston 12 can be easily slid in tube 1 in the first direction by pressing the end 17 of rod 15 against a tree, rock or firm ground until the arm 20 moves past the bow string 8. Then the string can be captured in the groove 23, and the rod released. The energy stored in tube 1 will slowly slide the piston 12 in the opposite direction until the desired pre-load position of the bow string is reached.

This method of pre-loading a bow is safe and protects the pre-loading mechanism from contaminants encountered by archers and hunters in the field because critical components are sealed inside of the hollow tube 1. Also, gas springs are relatively slow moving when they release stored energy, so the danger of misfiring an arrow is reduced when the bow string is being pre-loaded. The degree to which the bow string 8 is pre-loaded can be adjusted by loosening the clamp 25 and moving the hollow tube 1 with respect to the bow string and then re clamping the tube 1 in a different location. Use of counter weight 24 prevents our mechanism from unbalancing the bows to which it is attached.

While the present invention has been described with reference to particular embodiments and methods, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

We claim:

1. In an archery bow having a bow string for propelling arrows in a first direction, the improvement in a mechanism for pre-loading said bow string comprising a hollow tube connected to said bow, a piston slidable in said hollow tube, means for storing energy in said hollow tube when said piston slides in said first direction, and means for connecting said piston to said bow string so as to cause energy stored in said hollow tube to slide said piston in a direction opposite to said first direction and thereby to pre-load said bow string.

2. The archery bow define in claim 1, wherein said energy storing means comprises a fluid sealed inside of said hollow tube, and said fluid is compressed by sliding of said piston in said first direction.

3. The archery bow defined in claim 2, wherein said fluid comprises a gas sealed inside of said hollow tube, and said gas is compressed by sliding of said piston in said first direction.

4. The archery bow defined in claim 1, wherein said energy storing means comprises a spring enclosed inside of said hollow tube, and said spring is compressed by sliding of said piston in said first direction.

5. The archery bow defined in claim 1 further comprising a releasable clamp attached to said bow, said hollow tube being held in a predetermined position in said clamp with respect to said bow string that establishes the amount of energy stored in said hollow tube, and the position of said hollow tube being adjustable in said first and opposite directions so as to adjust the amount of energy stored in said hollow tube.

6. The archery bow defined in claim 5 further comprising, said archery bow having a hand grip with an arrow rest on one side thereof, and said clamp being attached to said hand grip on a side opposite to said one side.

7. The archery bow defined in claim 1 further comprising, a rod attached to said piston and having an end extending beyond said hollow tube in said opposite direction, and a bow string capture arm that is rotatable around said rod from a first position where it engages said bow string to second position when said bow string is released.

8. A compound archery bow comprising a hand grip, a pair of bow arms attached to said hand grip, a pulley attached to each bow arm, and a bow string for propelling arrows in a first direction, and a mechanism for pre-loading said bow string comprising a hollow cylindrical tube connected to said hand grip, one end of said hollow tube being closed and an opposite end of said hollow tube having an opening therein, said one end projecting beyond said hand grip in said first direction, a piston slidable in said hollow tube, a rod having one end attached to said piston inside of said hollow tube and an opposite end extending from said hollow tube through said opening in said opposite end of said hollow tube, a bow string capture arm connected to said opposite end of said rod, energy storing means inside of said hollow tube, sliding movement of said rod in said first direction moving said piston toward said closed end of said hollow tube so as to store energy inside of said hollow tube, and then capturing of said bow string by said arm enabling energy stored in said hollow tube to slide said piston in a direction opposite to said first direction so as to to pre-load said bow string.

9. The compound archery bow defined in claim 8, wherein said energy storing means comprises a fluid sealed inside of said hollow tube, and said fluid is compressed by movement of said piston in said one direction.

10. The compound archery bow defined in claim 9, further comprising a gas spring sealed inside of said hollow tube, and said gas spring being compressed by movement of said piston in said one direction.

11. The compound archery bow defined in claim 8, wherein said energy storing means comprises a coil spring enclosed inside of said hollow tube, and said spring is compressed by movement of said piston in said one direction.

12. The compound archery bow defined in claim 8, further comprising, said hand grip having an arrow rest on one side thereof, a releasable clamp attached to said hand grip on a side opposite to said arrow rest, said hollow tube being held on said opposite side in a predetermined position in said clamp that establishes the amount of energy stored in said hollow tube with said opposite end of said hollow tube protruding beyond said hand grip in said opposite direction, and the position of said hollow tube being adjustable in said first and opposite directions so as to adjust the amount of energy stored in said hollow tube.

13. The compound archery bow defined in claim 8, wherein said bow string capture arm is rotatable around said rod from a substantially horizontal position where it engages said bow string to a substantially vertical position when said bow string is released.

14. The compound archery bow defined in claim 8, further comprising a counterweight on said one end of said hollow tube.

15. A method of pre-loading a bow string of an archery bow that propels arrows in a first direction comprising, the steps of:

attaching a hollow tube to said archery bow, sliding a piston in said first direction inside of said tube so as to store energy in said tube, and causing said piston to engage and move said bow string as said piston is urged in a direction opposite to said first direction by release of the energy stored in said hollow tube.

16. The method of pre-loading a bow string of an archery bow defined in claim 15, further comprising sealing a fluid in said hollow tube and compressing said fluid by moving said piston in said first direction so as to store energy in said hollow tube.

17. The method of pre-loading a bow string of an archery bow defined in claim 15, further comprising sealing a gas in said hollow tube and compressing said gas by moving said piston in said first direction so as to store energy in said hollow tube.

18. The method of pre-loading a bow string of an archery bow defined in claim 17, further comprising providing a gas spring in said hollow tube.

19. The method of pre-loading a bow string of an archery bow defined in claim 15, further comprising enclosing a spring in said tube and compressing said spring by moving said piston in said first direction so as to store energy in said tube.

20. The method of pre-loading a bow string of an archery bow defined in claim 15, further comprising adjusting the pre-loading movement of said bow string by clamping said hollow tube on said bow, unclamping said hollow tube on said bow, moving said hollow tube and then clamping said hollow tube so that said piston moves said bow string a different amount in said opposite direction.

* * * * *